12/6/77 XR 4,061,934

United States Patent [19]

Rowe

[11] 4,061,934

[45] Dec. 6, 1977

[54] VIBRATION PICKUP UNIT FOR SENSING VIBRATIONS OF MUSICAL INSTRUMENTS AND THE LIKE

[75] Inventor: Horace N. Rowe, Swanton, Ohio

[73] Assignee: Rowe-DeArmond, Inc., Toledo, Ohio

[21] Appl. No.: 622,404

[22] Filed: Oct. 14, 1975

Related U.S. Application Data

[63] Continuation of Ser. No. 503,964, Sept. 6, 1974, abandoned.

[51] Int. Cl.[2] ..... H01L 41/04

[52] U.S. Cl. ..... 310/323; 310/358; 310/369

[58] Field of Search ..... 310/8.2, 8.3, 8.5, 8.6, 310/9.1, 9.4

[56] References Cited

U.S. PATENT DOCUMENTS

| | | | |
|---|---|---|---|
| 3,329,696 | 3/1966 | Burkhalter et al. | 310/8.6 |
| 3,387,149 | 6/1968 | Young | 310/8.5 |
| 3,573,394 | 4/1971 | Birnbaum | 310/9.1 |

OTHER PUBLICATIONS

Ultrasonic Engineering by J. R. Frederick, Wiley & Sons Inc., 1965, pp. 261, 262.

*Primary Examiner*—Mark O. Budd
*Attorney, Agent, or Firm*—Charles F. Schroeder

[57] ABSTRACT

An electrical pickup unit for sensing vibrations particularly in the audible range as produced by musical instruments such as stringed instruments like guitars and violins or wind instruments like trumpets and clarinets. The unit includes a flex or bender type piezoelectric element secured to a diaphragm resiliently mounted and adapted to sense the vibratory energy surfaces such as at the root of the strings of stringed instruments or at the bell of wind instruments.

1 Claim, 6 Drawing Figures

VIBRATION PICKUP UNIT FOR SENSING VIBRATIONS OF MUSICAL INSTRUMENTS AND THE LIKE

This is a continuation of application Ser. No. 503,964, filed Sept. 6, 1974, now abandoned.

This invention is related to electrical pickup units for sensing vibrations such as those produced in the audible frequency range by musical instruments, both of stringed and wind instrument types as well as percussion instruments, the signal from the unit being reproduceable in amplified form to provide an amplified output from the instrument.

Electromagnetic pickup units for stringed instruments have been in vogue and have provided excellent results for production of music in amplified form for many years. Such units have become such an integral part of some musical instruments that instruments themselves have been modified to provide the fidelity desired in amplified musical outputs to a degree that in many instances the instruments are not adaptable to being played without such amplification. Use of electrical outputs have been limited to an extent and have found greatest use in stringed instruments such as steel guitars wherein the electromagnetic pickups have been able to sense the vibrations of strings of electrically conductive or magnetic material. Stringed instruments utilizing non-conductive or non-magnetic strings, however, have not been provided equal capability of amplification since pickup units heretofore adaptable to sensing strings of dielectric material reliant upon electrostatic force principles have not enabled signal pickup of magnitude, or of character, or with ease of adaptability to promote their use for such stringed instruments.

According to the present invention, however, a new type of pickup unit is provided which functions independently of the electrical conductivity of elements causing vibration by utilizing a bender type piezoelectric element for sensing vibrations of a surface and for converting vibratory energy into electrical energy. Piezoelectric elements have been used in prior art pickup units but these have been principally of compression type requiring pressure variation for generation of electrical signals such as the pressure variation as might be imparted in the gap of a violin bridge or in the mouthpiece of a windblown instrument. Such units are often subjected to compression forces by sources other than those which correspond to musical vibration, such as by a mounting clamp or the extraneous forces imparted by the actuating elements which are required to be rigid in character to obtain the compressive force necessary for signal generation. Musical signals under such conditions are generated by superposed, usually much lesser compressive forces of vibration and correspondingly result in relatively small signal outputs requiring preamplification before input to a conventional amplifier. In the present pickup unit, the bender type piezoelectric element is incorporated in an arrangement in which the element is sympathetically sensitive to minute vibrations and is allowed to vibrate with a degree of freedom in a floating sense in a resilient media such that it will generate signals of magnitude adequate for direct amplification without preamplification.

It is still another object of the present invention to provide an electrical pickup unit for both stringed and wind instruments whether or not the vibratory surface or elements sensed by the pickup unit are electrically conductive, magnetic, or dielectric in character.

It is another object of the present invention to provide a method for making an electrical pickup unit which is non-critical in procedure yet which provides a unit having a sensitivity to vibration over a wide range of frequencies while at the same time being capable of economical construction and being extremely rugged and stable and readily adapted to association with a vibratory means.

In brief, these objectives are attained according to the present invention by providing a pickup unit incorporating a bender type piezoelectric element integrally and electrically mounted on a vibratile diaphragm and supported on a resilient medium which allows freedom for bending movement of the element in sympathy with the vibrations being sensed. The diaphragm may be actuated by vibratory energy of the surface through a resilient communicating element extended over an area of the diaphragm.

Features of the invention lie in its ruggedness against rough handling yet sensitivity to minute vibrations.

Another feature of the invention lies in its ease of construction with reliability and stability in operation with a minimum tendency toward deviation from specification.

A still further feature of the invention lies in its adaptability to existing amplifier equipment for musical output without need for preamplification of electrical signals corresponding to the vibrating source.

Other objects and features which are believed to be characteristic of my invention are set forth with particularity in the appended claims. My invention, however, both in organization and manner of construction, together with further objects and advantages thereof, may be best understood by reference to the following description taken in connection with the accompanying drawing in which:

Figure 1:
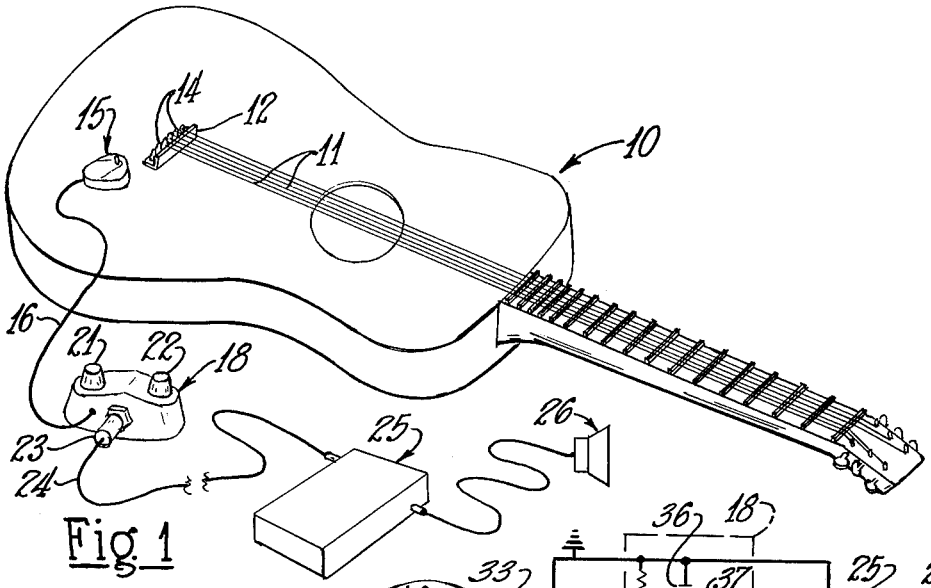
FIG. 1 illustrates a stringed musical instrument utilizing a pickup unit of the present invention and showing the general arrangement of electrical amplifying equipment assembled therewith for amplification of the output of the instrument.

Referring to the drawing in greater detail, FIG. 1 shows a guitar 10 having strings 11 extending over the sound chamber across the bridge member 12 and secured to fixed anchor elements on posts 14. The pickup unit of the invention is located on the exterior surface of the sound chamber in the vicinity of the root of the strings of the instrument or another location on the surface of the instrument where vibratory energy can be imparted to the pickup unit. The surface vibrations sensed by the pickup unit 15 are translated into electrical signals which are fed by way of a shielded conductor 16 to a control unit 18 which can be provided with volume and tone controls 21 and 22 respectively. The electrical signals are then fed by way of a shielded cable 24 to an amplifier unit 25 from which it is fed to the loudspeaker unit 26 for translation into audible mechanical vibrations.

Figure 3:
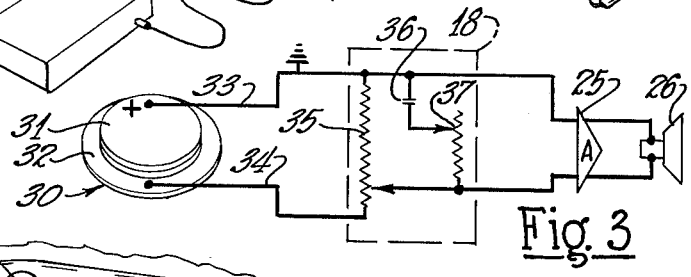
FIG. 3 is a schemetic electric circuit drawing illustrating the manner in which the piezoelectric element of the unit may be connected for filtering and amplification of electrical signals generated thereby.

The piezoelectrical material utilized in the pickup of the present invention is in the form of a circular flex type piezoelectric element 31 which will generate electrical signals in response to application of bending forces. The element can be of a single layer of such material but a higher voltage signal output is attained from a sandwich-like structure of two overlying piezoelectric layers polarized to make them anisotropic. The two plates or layers of ceramic piezoelectric material are polarized such that one face of the combination is plus and the other is negative. As illustrated in FIG. 3, the upper face of the ceramic element 31 of the vibration sensing component 30 is positive while the negative face is adhesively secured concentrically by electrically conductive cement to a slightly larger diameter metallic diaphragm 32.

A pair of wire leads 33 and 34 are electrically connected, such as by being soldered, to the positive face of the ceramic sandwich structure or element 31 and the diaphragm 32, respectively, of the vibration sensing component 30. The leads 33 and 34 are also connected across a voltage dividing resistance 35 providing a volume control for the signal generated by the element 31. The leads, in addition are connected across a condenser 36 in series with a variable resistance 37 which in combination form a filter circuit for the vibration signal to be amplified. The much desired tonal qualities of fine instruments might be further enhanced by selective amplification through other commercially available filtering arrangements. The electrically filtered output is then fed to an amplifier 25 for audible reproduction by a loudspeaker 26.

The diaphragm 32 on which the piezoelectric sandwich assembly is mounted is made sufficiently thin to vibrate in accordance with the vibrations to be sensed and in an operating frequency range not including the resonant frequency of the device to assure reliable reproduction in close matched relation to the output of the instrument with which it is associated.

Figure 2:
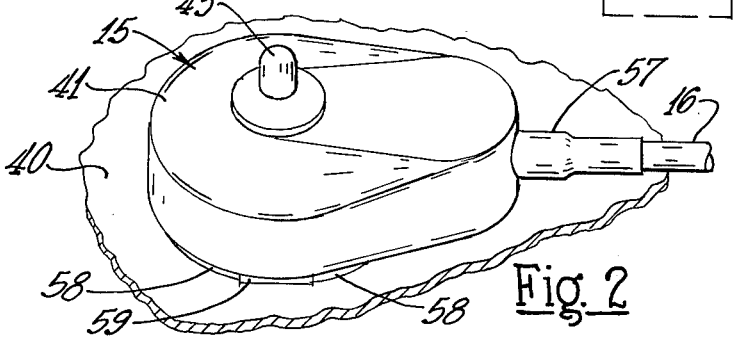
FIG. 2 is an enlarged perspective view of the pickup unit of the invention shown in operating communication with a vibratory surface representative of a surface of a wide variety of instruments and apparatus with which the unit can be utilized.
Figure 4:
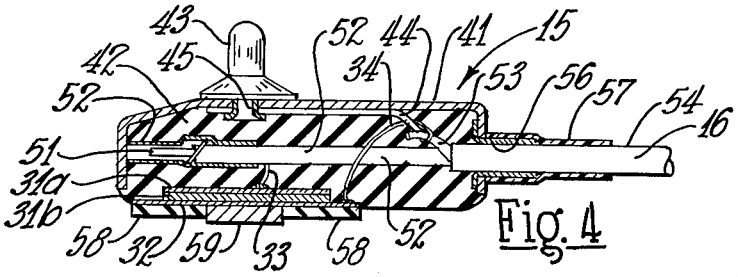
FIG. 4 is a side-elevational view in cross-section of the pickup unit shown in FIG. 2.
Figure 5:
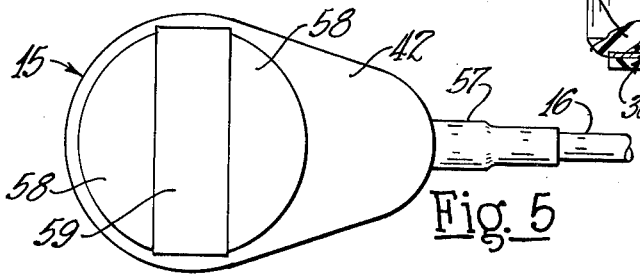
FIG. 5 is a bottom plan view of the pickup unit shown in FIGS. 2 and 4.

FIGS. 2, 4 and 5 are enlarged illustrations of the physical arrangement and assembly of components making up the pickup unit 15 shown in use in FIG. 1. The casing or cover 41 of metal such as brass, is open on one side to permit filling with a potting compound 42 such as silicone rubber. The potting compound is selected to provide a resilient surface, durable yet readily installed in the casing such as by being poured and cured to a stable resilient condition, and at the same time adapted to reliable, support and securement of the vibration responsive component 30. A compound having a resilient hardness in the order of 45–55 durometer has been found quite successful in providing the resilient support of the vibratile component for the pickup response desired. A silicone rubber potting compound curable at room temperature, sold as RTV 11 by the General Electric Company, having a handleable condition in 3 to 4 hours, dependent upon the catalyst used, and a full cure time in the order of 48 hours, has proven quite satisfactory for this purpose.

Prior to pouring the potting compound 42 into the casing 41, the electrical circuit elements of pickup unit are first assembled into the casing and the compound is then poured into and about the elements causing the compound to be a matrix fully enclosing the circuit elements. The vibration sensing component 30 is then mounted on the exposed surface of the matrix compound while it is still plastic prior to its complete cure. A metallic lug 44 of copper or other low resistance material is first inserted into the casing and then electrically connected to the inner wall of the casing such as by soldering. An exterior anchor pin 43 of metal such as brass is then mounted on the casing 41 by passing a bottom projection 45 through aligned apertures of the casing 41 and the lug 44 respectively to permit flaring out of the end of the projection 45 to form a flange on the interior of the pickup casing about the aperture in the lug 44. This positively secures the anchor pin in place and at the same time establishes a still more positive physical bond between the lug 44 and the casing 41.

The end of the coaxial lead cable 16 is then inserted through an opening in the side of the casing 41 to permit its electrical connection to the vibration sensing component 30. The end of the central conductor 51 is extended to the opposite side of the casing from that into which it is introduced, with the insulation 52 stripped back therefrom for a short distance to permit the wire 33 soldered to the positive face of the piezoelectric element to be electrically connected to the core wire 51 by soldering it thereto. A relatively short length of electrical insulating tubing of a heat shrinkable material such, for example, as a molecularly oriented synthetic resin like that sold by the E. I. du Pont de Nemours and Company, under the trademark Mylar, is first heat shrunk about the stripped back length of conductor 51 and is mounted about the end of the insulation 52 for extension as a protective barrier about the bared section of the central conductor 51. Correspondingly the concentric woven shield conductor 53 of the coaxial cable 16 is made bare by stripping back its outer insulating layer 54 for a short distance on the interior of the casing 41 to permit its being grounded to the casing by electrically connecting it, such as by solder, to the metallic lug 44.

The cable 16 is mounted in position at the entrance to the casing 41 where it passes through a tubular eyelet 56 of short length having a flanged portion on the interior of the casing from which it projects outwardly in snug fit relation from the side aperture in the casing to stablely hold the cable 16 in its place at its entrance to the casing 41. An outer protective portion of plastic tubing 57 is snugly fitted about and extends over the end of the exterior portion of the eyelet 56 to form a shoulder and an end portion thereof in tight fit moisture resistant association about the outer insulating layer 54 of the cable 16.

Now referring to the physical arrangement of the vibration sensing component 30 as shown in FIG. 4, the positive side of the sandwiched piezoelectric flex element 31 is made up of a positive surface layer **31*a* and a negative surface layer 31*b* which is electrically secured to the diaphragm 32 such as by an electrically conductive cement interposed between the negative face of the element 31 and the diaphragm face 32. The lead wire 34 soldered to the grounding lug 44 is electrically connected to the marginal region of the diaphragm 32 such as by being soldered thereto. The component 30 is pressed into place in the potting compound 42 within the case 41 prior to final cure thereof, thereby resiliently supporting the component 30 for floating response to sensed vibrations transmitted thereto and generation of corresponding electrical signals. In this regard, the piezoelectric flex or bender element 31 as shown in FIG. 4 is surrounded by the resilient matrix compound 42 and is held in position by the diaphragm 32 which is mounted at the surface of the matrix compound for receipt of vibratory energy. The matrix compound 42 is poured in quantities sufficient to project slightly beyond the edges of the open face of the casing 41 and to hold the diaphragm 32** in an exposed position for receipt of vibration energy from surfaces on which it might be mounted.

By way of example of dimensions of a successfully operable component 30, the diaphragm may have a diameter of ¾ inch and a thickness of 0.012 inch. The diameter of the flex type piezoelectric wafer 31 cemented thereto may be ½ inch and also have a thickness of 0.012 inch. Bender or flexing piezoelectric wafers of this type are commercially available under the tradename "Bimorph" from the Vernitron Company.

It has been found that vibratory energy can be transmitted to the diaphragm 32 more readily if a transmission element such as a band of cork 59 is provided extending over an area such as across the mid-region of the diaphragm which is firm but yet lends itself to an intimate more readily conforming association with a corresponding area of the vibratory surface from which the energy is to be received. A material of sheet-like form such as cork which by way of example has a thickness dimension in the order of 1/16 to 3/16 inch and a width of ⅜ inch which has a degree of firmness and yet resiliency to conform to surfaces from which energy is to be received, forms an excellent medium of transmission of vibratory energy from a surface 40 as on the face of an instrument. Although a button type or a needle type contacting element might transmit energy from a vibration surface to the diaphragm 32, the provision of an area of contact with the vibratory surface through a layer of firm but resilient cork-like material permits establishment of intimate communicating association of the diaphragm with somewhat irregular as well as perfectly planar surfaces.

In addition, such an energy transmitting medium also dampens and limits damage or tendencies toward transmission of extraneous vibrations such for example, as from sharp knocks on the instrument.

The pickup unit 15 can be secured in place on a vibratory surface such as by adhesive faced foam rubber pads 58 on each side of the energy transmitting cork strip 59. The pads are coated on both sides with a pressure sensitive adhesive which permits their attachment to the edge regions of the diaphram 32. The foam pads can be equal or slightly less in thickness than the cork strip to promote intimate association of the strip with a vibratory surface. The outer adhesive face portions of the pads 58 are covered with a non-adhesive film which permits ready handling of the pickup unit prior to installation. When the pickup unit is to be installed, the protective film portions on the pads 58 are peeled back exposing the adhesive coating material ready for application of the unit 15 to the face of the instrument as illustrated in FIG. 1.

While the pickup unit thus adhesively secured to the instrument provides admirable results in amplification of vibration signals received from the surface, in other piezoelectric pickup arrangements relying upon variations in pressure for production of electrical energy corresponding to mechanical vibrations, mere adhesive securement of the pickup unit to the vibrating surface is not satisfactory. The present pickup unit in contrast is flexibly adaptable to any of a number of means of mounting on the vibratory surface and still provide successful results in that it is the bending or flexing of the piezoelectric element that causes generation of electrical signals corresponding to vibrations rather than pressure variations on the element. Still further in this regard, the resilient support of the diaphram and piezoelectric element is desired in the present arrangement whereas in pressure reactive piezoelectric elements, such resilient support of signal generating unit is in conflict with assurance of true reproduction of signals corresponding to the vibration signals of the surface sensed. The resilient support in the present arrangement, in contrast to rigid support, further lends to ruggedness and durability of the pickup unit as well as assured intimate communication of the pickup unit with vibratory surface sensed.

As an alternate or additional means of securement, the pickup unit might be held in communication with an instrument by use of stretch bands like rubber bands extended across and engaging the top of the pickup unit 15 on both sides of the anchor pin 43. The pickup unit thus can be firmly secured to the face of an instrument with the vibration transmitting medium 59 interposed between the diaphragm 32 and the surface of vibration.

Still further, the pickup unit can be secured against the vibrating surface with a bracket or clip and, in some instances where found desirable, the cork transmitting medium can be omitted placing the resiliently supported diaphragm directly in communication with the vibrating surface.

Figure 6:
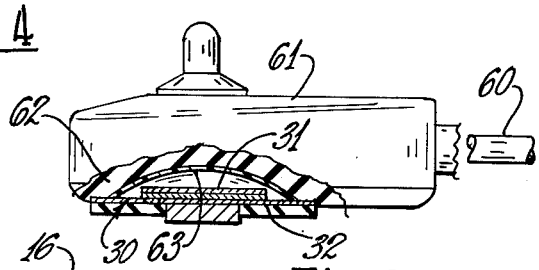
FIG. 6 is a side-elevational view partially in cross section of another arrangement for resiliently supporting the piezoelectric element in the pickup unit of the present invention.

FIG. 6 illustrates another embodiment of the present invention similar to that shown in FIGS. 1, 2 and 5 but differing in arrangement in that the piezoelectric flex element is free of communication with the matrix compound in the casing. The diaphragm 32 is supported by the resilient compound material 62 in the same manner as in the arrangement illustrated in the preceding figures but the bender type piezoelectric element is enclosed in a space enclosing cover such as a dished plastic cover which in a sense forms an air bubble or pocket for the bender element 31 within the matrix 62 providing space for a greater freedom of bending of the element 31. In all other respects the principles of operation are similar. For some purposes the air pocketed piezoelectric bender element will perform more desirably while in others the corresponding piezoelectric element fully surrounded in resilient potting compound will provide more desirable results. In the latter respect, greater dampening effect from extraneous vibrations are possible assuring musically true sound reproduction while in others where vibration energy might be of a weaker character the more free vibratory action of the piezoelectric element in the air pocketed assembly of FIG. 6 may be more desirable.

Also as a variation in construction, whereas the material providing the resilient support of the diaphragm is shown to be a single mass forming the matrix on the interior of the casing, the resilient support surface can be provided by an outer layer of resilient material over an underlying harder or non-resilient material on the interior of the casing, or such resilient support surface can be provided by or on a monolithic matrix and casing combination as may be desired such as for economy of construction. Thus while the disclosure sets forth particular forms of my invention, it should be understood that it is intended that the invention not be limited specifically thereto, since many modifications may be made within the broad concept of the invention, and it is therefore contemplated by the appended claims to cover all modifications falling within the true spirit and scope of the invention.

I claim:

1. A pickup unit for translation of mechanical vibrations such as of musical instruments and the like into electrical signals of corresponding frequency comprising;

a casing for said pickup unit having at least one open wall, a vibratable diaphragm, a flex type piezoelectric element bonded to the surface of said diaphragm, means resiliently supporting said diaphragm and piezoelectric element at the open wall of said casing with said piezoelectric element disposed on the interior casing side thereof, a vibration transmitting means comprising a layer of cork secured to said diaphragm and securing means on each side of said vibration transmitting means comprising resilient foam material having an adhesive surface.

* * * * *